US012618019B2

(12) United States Patent
Horita

(10) Patent No.: US 12,618,019 B2
(45) Date of Patent: May 5, 2026

(54) LUBRICATING OIL COMPOSITION FOR TWO-WHEELED VEHICLE

(71) Applicant: IDEMITSU KOSAN CO., LTD., Tokyo (JP)

(72) Inventor: Naoto Horita, Chiyoda-ku (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 18/849,213

(22) PCT Filed: Feb. 8, 2023

(86) PCT No.: PCT/JP2023/004072
§ 371 (c)(1),
(2) Date: Sep. 20, 2024

(87) PCT Pub. No.: WO2023/188839
PCT Pub. Date: Oct. 5, 2023

(65) Prior Publication Data

US 2025/0207056 A1 Jun. 26, 2025

(30) Foreign Application Priority Data

Mar. 31, 2022 (JP) ..... 2022-061224

(51) Int. Cl.

| | |
|---|---|
| ***C10M 169/04*** | (2006.01) |
| ***C10M 135/18*** | (2006.01) |
| ***C10M 137/10*** | (2006.01) |
| ***C10M 141/10*** | (2006.01) |
| *C10N 30/00* | (2006.01) |
| *C10N 30/02* | (2006.01) |
| *C10N 40/02* | (2006.01) |

(52) U.S. Cl.
CPC ..... *C10M 169/04* (2013.01); *C10M 135/18* (2013.01); *C10M 137/10* (2013.01); *C10M 141/10* (2013.01); *C10M 2203/003* (2013.01); *C10M 2219/068* (2013.01); *C10M 2223/045* (2013.01); *C10N 2030/02* (2013.01); *C10N 2030/43* (2020.05); *C10N 2040/02* (2013.01)

(58) Field of Classification Search
CPC ..... C10M 169/04; C10M 135/18; C10M 137/10; C10M 141/10; C10M 2203/003; C10M 2219/068; C10M 2223/045; C10M 139/00; C10N 2030/02; C10N 2030/43; C10N 2040/02
See application file for complete search history.

(56) References Cited

U.S. PATENT DOCUMENTS

| | | | | |
|---|---|---|---|---|
| 5,672,572 | A * | 9/1997 | Arai | C10M 101/02 508/374 |
| 6,063,741 | A * | 5/2000 | Naitoh | C10M 135/24 508/572 |
| 6,300,291 | B1 * | 10/2001 | Hartley | C10M 129/10 508/363 |
| 6,723,685 | B2 * | 4/2004 | Hartley | C10M 163/00 508/374 |
| 2009/0082233 | A1 | 3/2009 | Kasai | |
| 2009/0163392 | A1 * | 6/2009 | Boffa | C10M 141/10 508/161 |
| 2010/0331224 | A1 * | 12/2010 | Boffa | C10M 141/10 508/369 |
| 2014/0378355 | A1 | 12/2014 | Matsui et al. | |
| 2015/0203785 | A1 | 7/2015 | Matsui et al. | |
| 2017/0121626 | A1 | 5/2017 | Nakaya et al. | |
| 2017/0204347 | A1 * | 7/2017 | Marcella | F02B 75/02 |
| 2019/0106648 | A1 | 4/2019 | Kusumoto et al. | |
| 2022/0389345 | A1 * | 12/2022 | Shao | C10M 125/10 |

FOREIGN PATENT DOCUMENTS

| | | | | |
|---|---|---|---|---|
| EP | 0699739 | A2 * | 3/1996 | C10M 135/22 |
| JP | 2001-214184 | A | 8/2001 | |
| JP | 2003/41283 | A | 2/2003 | |
| JP | 2006-328265 | A | 12/2006 | |
| JP | 2021/31577 | A | 3/2021 | |
| WO | WO-9428095 | A1 * | 12/1994 | C10M 169/045 |
| WO | WO 2006/126651 | A1 | 11/2006 | |
| WO | WO 2013/125106 | A1 | 8/2013 | |
| WO | WO 2014/017559 | A1 | 1/2014 | |
| WO | WO 2016/158971 | A1 | 10/2016 | |
| WO | WO 2017/170948 | A1 | 10/2017 | |

OTHER PUBLICATIONS

International Search Report issued Apr. 25, 2023 in PCT/JP2023/004072 (with English Translation), 7 pages.
Written Opinion of the International Searching Authority issued Apr. 25, 2023, in PCT/JP2023/004072 (with English Translation), 8 pages.

* cited by examiner

*Primary Examiner* — Ellen M McAvoy
(74) *Attorney, Agent, or Firm* — Oblon, McClelland, Maier & Neustadt, L.L.P.

(57) ABSTRACT

Provided is a lubricating oil composition for a two-wheeled vehicle, containing a base oil, (A) a zinc dialkyldithiophosphate, and (B) a molybdenum-based friction modifier, in which a mass ratio (P/Mo) of a content of a phosphorus atom derived from the zinc dialkyldithiophosphate (A) to a content of a molybdenum atom derived from the molybdenum-based friction modifier (B) is 0.8 or more and less than 2.0, and a kinematic viscosity at 100° C. is 5.0 to 7.1 $mm^2/s$, the lubricating oil composition for a two-wheeled vehicle by which excellent fuel efficiency is achieved.

20 Claims, No Drawings

LUBRICATING OIL COMPOSITION FOR TWO-WHEELED VEHICLE

CROSS-REFERENCE TO RELATED APPLICATIONS

This application is a national stage application of International Application No. PCT/JP2023/004072, filed Feb. 8, 2023, which is based upon and claims the benefit of priority to Japanese Patent Application No. 2022-061224, filed Mar. 31, 2022. The entire contents of these applications are incorporated herein by reference.

TECHNICAL FIELD

The present invention relates to a lubricating oil composition for a two-wheeled vehicle.

BACKGROUND ART

In recent years, for a reduction in environmental loads, vehicles such as an automobile are required to have enhanced fuel efficiency.

As a method for enhancing fuel efficiency, a method using a lubricating oil composition containing a zinc dialkyldithiophosphate or an organic molybdenum compound has been known (e.g., see PTL 1).

CITATION LIST

Patent Literature

PTL 1: JP 2006-328265 A

SUMMARY OF INVENTION

Technical Problem

However, in PTL 1, a study on the ratio between the content of a zinc dialkyldithiophosphate and the content of an organic molybdenum compound is not necessarily sufficient from the viewpoint of fuel efficiency.

The present invention has been made in view of the problem described above, and an object of the present invention is to provide a lubricating oil composition for a two-wheeled vehicle having excellent fuel efficiency.

Solution to Problem

The inventors of the present invention have found that the problem can be solved by a lubricating oil composition for a two-wheeled vehicle in which the mass ratio (P/Mo) of the content of a phosphorus atom derived from (A) a zinc dialkyldithiophosphate to the content of a molybdenum atom derived from (B) a molybdenum-based friction modifier is 0.8 or more and less than 2.0 and the kinematic viscosity at 100° C. is 5.0 to 7.1 $mm^2/s$, and completed the present invention.

Specifically, the present invention provides the following [1] to [7].

[1] A lubricating oil composition for a two-wheeled vehicle, containing a base oil, (A) a zinc dialkyldithiophosphate, and (B) a molybdenum-based friction modifier, in which a mass ratio (P/Mo) of a content of a phosphorus atom derived from the zinc dialkyldithiophosphate (A) to a content of a molybdenum atom derived from the molybdenum-based friction modifier (B) is 0.8 or more and less than 2.0, and a kinematic viscosity at 100° C. is 5.0 to 7.1 $mm^2/s$.

[2] The lubricating oil composition for a two-wheeled vehicle according to [1], in which the zinc dialkyldithiophosphate (A) has a secondary alkyl group.

[3] The lubricating oil composition for a two-wheeled vehicle according to [1] or [2], in which the content of a phosphorus atom derived from the zinc dialkyldithiophosphate (A) is 600 to 900 ppm by mass % by mass.

[4] The lubricating oil composition for a two-wheeled vehicle according to any one of [1] to [3], in which the content of a molybdenum atom derived from the molybdenum-based friction modifier (B) is 400 to 800 ppm by mass.

[5] The lubricating oil composition for a two-wheeled vehicle according to any one of [1] to [4], in which a content of a sulfur atom derived from the zinc dialkyldithiophosphate (A) is 0.12 to 0.22% by mass.

[6] The lubricating oil composition for a two-wheeled vehicle according to any one of [1] to [5], in which a kinematic viscosity at 40° C. of the base oil is 18.0 to 24.0 $mm^2/s$.

[7] The lubricating oil composition for a two-wheeled vehicle according to any one of [1] to [6], in which the lubricating oil composition is used for a two-wheeled vehicle having an engine with a roller bearing.

Advantageous Effects of Invention

The present invention can provide a lubricating oil composition for a two-wheeled vehicle having excellent fuel efficiency (hereinafter also referred to as "lubricating oil composition").

DESCRIPTION OF EMBODIMENTS

In this description, the lower limit values and the upper limit values described in a stepwise manner in a preferred numerical range (for example, ranges of a content, and the like) can be each independently combined. For example, the expression "preferably 10 to 90, more preferably 30 to 60" can mean "10 to 60" by combining "a preferable lower limit value (10)" and "a more preferable upper limit value (60)". Similarly, in this description, a numerical value "or more", a numerical value "or less", "less than" a numerical value, and "more than" a numerical value, which relate to a numerical range, are values that can be optionally combined.

Base Oil

As a base oil used in the present embodiment, a mineral oil and a synthetic oil are used.

<Mineral Oil and Synthetic Oil>

The base oil may include one or more types selected from a mineral oil and a synthetic oil, or may include a mineral oil and a synthetic oil.

Examples of the mineral oil include atmospheric residue obtained by atmospheric distillation of crude oil such as a paraffinic crude oil, an intermediate base crude oil, and a naphthenic crude oil; distillate oils obtained by vacuum distillation of the atmospheric residue; and mineral oils obtained by subjecting the distillate oils to one or more of refining treatments such as solvent deasphalting, solvent extraction, hydrocracking, solvent dewaxing, catalytic dewaxing, and hydrogenation refining.

Examples of the synthetic oil include poly-α-olefins such as an α-olefin homopolymer and an α-olefin copolymer (e.g., α-olefin copolymers having 8 to 14 carbon atoms such as an ethylene-α-olefin copolymer); isoparaffins; various esters such as a polyol ester and a dibasic acid ester; various ethers such as polyphenyl ether; polyalkylene glycols; alkylbenzenes; alkylnaphthalenes; and GTL base oils obtained by isomerization of wax (GTL wax (GasToLiqiudsWAX)) produced from natural gas by the Fischer-Tropsch process and the like.

The kinematic viscosity and viscosity index of the base oil are not particularly limited, and for example, the kinematic viscosity at 100° C. of the base oil is preferably 1.0 $mm^2/s$ or more, more preferably 2.0 $mm^2/s$ or more, and still more preferably 2.5 $mm^2/s$ or more, and preferably 7.0 $mm^2/s$ or less, more preferably 6.5 $mm^2/s$ or less, and still more preferably 6.2 $mm^2/s$ or less. The upper limit values and the lower limit values can be optionally combined. Specifically, the kinematic viscosity at 100° C. is preferably 1.0 to 7.0 $mm^2/s$, more preferably 2.0 to 6.5 $mm^2/s$, and still more preferably 2.5 to 6.2 $mm^2/s$.

The viscosity index of the base oil is preferably 80 or more, more preferably 90 or more, and still more preferably 100 or more.

The kinematic viscosity at 40° C. of the base oil is preferably 18.0 to 24.0 $mm^2/s$.

The kinematic viscosity and the viscosity index as used herein mean values measured or calculated in accordance with JIS K 2283:2000.

In the lubricating oil composition of the embodiment, the content of the base oil is not particularly limited, and for example, it is preferably 60.0 to 99.0% by mass, more preferably 70.0 to 98.0% by mass, still more preferably 80.0 to 97.0% by mass, and particularly preferably 85.0 to 95.0% by mass, relative to the whole amount (100% by mass) of the lubricating oil composition.

(A) Zinc Dialkyldithiophosphate

In the lubricating oil composition of the embodiment, as a component (A), a zinc dialkyldithiophosphate (hereinafter sometimes abbreviated as "ZnDTP") is used. Examples of the zinc dialkyldithiophosphate include zinc dialkyldithiophosphates of structures represented by the following general formula (I).

(I)

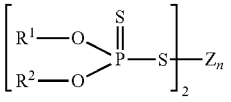

(In the formula, $R^1$ and $R^2$ are each independently a primary or secondary alkyl group having 3 to 22 carbon atoms, or an alkylaryl group substituted by an alkyl group having 3 to 18 carbon atoms.)

Herein, examples of the primary or secondary alkyl group having 3 to 22 carbon atoms include primary or secondary propyl, butyl, pentyl, hexyl, octyl, decyl, dodecyl, tetradecyl, hexadecyl, octadecyl, and icosyl groups. Examples of the alkylaryl group substituted by an alkyl group having 3 to 18 carbon atoms include a propylphenyl group, a pentylphenyl group, at octylphenyl group, a nonylphenyl group, and a dodecylphenyl group.

In the lubricating oil composition of the embodiment, as the component (A), the zinc dialkyldithiophosphate represented by the general formula (I) may be used alone, or two or more types thereof may be used in combination. In particular, the lubricating oil composition containing as a main component the zinc dialkyldithiophosphate having a secondary alkyl group, more specifically the zinc dialkyldithiophosphate in which $R^1$ and $R^2$ in the general formula (I) are a secondary alkyl group is preferred in terms of enhancing the fuel efficiency. Therefore, the content of the zinc dialkyldithiophosphate having a secondary alkyl group in the component (A) is preferably 50% by mass or more, more preferably 70% by mass or more, and still more preferably 90% by mass or more.

In the lubricating oil composition of the embodiment, the content of a phosphorus atom derived from the zinc dialkyldithiophosphate of the component (A) is preferably in the range of 600 to 900 ppm by mass relative to the whole amount (100% by mass) of the lubricating oil composition. When the content of the phosphorus atom is 600 ppm by mass or more, favorable fuel efficiency is exerted. In contrast, when the content of the phosphorus atom is 900 ppm by mass or less, the catalyst poison of an exhaust gas catalyst can be reduced.

(B) Molybdenum-Based Friction Modifier

In the lubricating oil composition of the embodiment, as a component (B), a molybdenum-based friction modifier is used. Examples of the molybdenum-based friction modifier include molybdenum dithiocarbamates (hereinafter sometimes abbreviated as "MoDTCs"), molybdenum dithiophosphates (hereinafter sometimes abbreviated as "MoDTPs"), and molybdenum amine complexes. One kind of the molybdenum-based friction modifier may be used alone, or two or more kinds thereof may be used in combination.

Among these, one or more selected from the group consisting of the molybdenum dithiocarbamates and the molybdenum amine complexes are preferred from the viewpoint of reducing an intermetallic friction coefficient to achieve excellent fuel efficiency.

Examples of the molybdenum dithiocarbamates include binuclear molybdenum dithiocarbamates having two molybdenum atoms in one molecule, and trinuclear molybdenum dithiocarbamates having three molybdenum atoms in one molecule.

In other words, in the embodiment, the molybdenum-based friction modifier (B) preferably contains one or more selected from the group consisting of the binuclear molybdenum dithiocarbamates, the trinuclear molybdenum dithiocarbamates, and the molybdenum amine complexes.

Hereinafter, the molybdenum-based friction modifier will be described in detail.

<Binuclear Molybdenum Dithiocarbamate>

Examples of the binuclear molybdenum dithiocarbamates include compounds represented by the following general formula (1), and compounds represented by the following general formula (2).

(1)

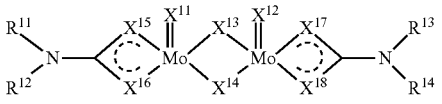

(2)

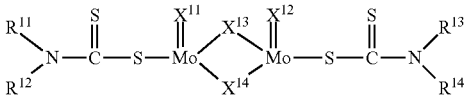

In the general formulae (1) and (2), $R^{11}$ to $R^{14}$ each independently represent a hydrocarbon group, and may be the same or different from each other.

$X^{11}$ to $X^{18}$ each independently represent an oxygen atom or a sulfur atom, and may be the same or different from each other. Provided that at least two of $X^{11}$ to $X^{18}$ in the formula (1) are a sulfur atom.

The number of carbon atoms in the hydrocarbon group that can be selected as $R^{11}$ to $R^{14}$ is preferably 6 to 22.

Examples of the hydrocarbon group that can be selected as $R^{11}$ to $R^{14}$ in the general formulae (1) and (2) include alkyl groups, alkenyl groups, cycloalkyl groups, aryl groups, alkylaryl groups, and arylalkyl groups.

Examples of the alkyl groups include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of the alkenyl groups include a hexenyl group, a heptenyl group, an octenyl group, a nonenyl group, a decenyl group, an undecenyl group, a dodecenyl group, a tridecenyl group, a tetradecenyl group, and a pentadecenyl group.

Examples of the cycloalkyl groups include a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group.

Examples of the aryl groups include a phenyl group, a naphthyl group, an anthracenyl group, a biphenyl group, and a terphenyl group.

Examples of the alkylaryl groups include a tolyl group, a dimethylphenyl group, a butylphenyl group, a nonylphenyl group, and a dimethylnaphthyl group.

Examples of the arylalkyl groups include a methylbenzyl group, a phenylmethyl group, a phenylethyl group, and a diphenylmethyl group.

Among these, a molybdenum dialkyldithiocarbamate (M1) represented by the following general formula (m1) (hereinafter also referred to as "compound (M1)") is preferred.

(m1)

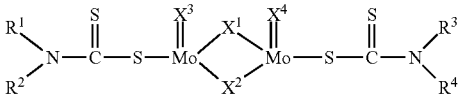

In the general formula (m1), $R^1$, $R^2$, $R^3$, and $R^4$ each independently represent a short-chain substituent group (α) that is an aliphatic hydrocarbon group having 4 to 12 carbon atoms or a long-chain substituent group (β) that is an aliphatic hydrocarbon group having 13 to 22 carbon atoms. Provided that the molar ratio [(α)/(β)] of the short-chain substituent group (α) to the long-chain substituent group (β) in all the molecules of the compound (M1) is 0.10 to 2.0. In the general formula (m1), $X^1$, $X^2$, $X^3$, and $X^4$ each independently represent an oxygen atom or a sulfur atom.

Examples of the aliphatic hydrocarbon group having 4 to 12 carbon atoms that can be selected as the short-chain substituent group (α) include alkyl groups having 4 to 12 carbon atoms and alkenyl groups having 4 to 12 carbon atoms.

Specific examples thereof include a butyl group, a pentyl group, a hexyl group, a heptyl group, an octyl group, a nonyl group, a decyl group, an undecyl group, a dodecyl group, a butenyl group, a pentenyl group, a hexenyl group, a heptenyl group, an octenyl group, a nonenyl group, a decenyl group, an undecenyl group, and a dodecenyl group. The groups may be linear or branched.

The number of carbon atoms in the aliphatic hydrocarbon group that can be selected as the short-chain substituent group (α) is preferably 5 to 11, more preferably 6 to 10, and still more preferably 7 to 9 from the viewpoint of facilitating exertion of the effects of the present invention.

Examples of the aliphatic hydrocarbon group having 13 to 22 carbon atoms that can be selected as the long-chain substituent group (β) include alkyl groups having 13 to 22 carbon atoms and alkenyl groups having 13 to 22 carbon atoms.

Specific examples thereof include a tridecyl group, a tetradecyl group, a pentadecyl group, a hexadecyl group, a heptadecyl group, an octadecyl group, a nonadecyl group, an icosyl group, a henicosyl group, a docosyl group, a tridecenyl group, a tetradecenyl group, a pentadecenyl group, a hexadecenyl group, a heptadecenyl group, an octadecenyl group, an oleyl group, a nonadecenyl group, an icosenyl group, a henicosenyl group, and a docosenyl group. The groups may be linear or branched.

The number of carbon atoms in the aliphatic hydrocarbon group that can be selected as the long-chain substituent group (β) is preferably 13 to 20, more preferably 13 to 16, and still more preferably 13 to 14 from the viewpoint of facilitating exertion of the effects of the present invention.

Herein, in the compound (M1) represented by the general formula (m1), the molar ratio [(α)/(β)] of the short-chain substituent group (α) to the long-chain substituent group (β) in all the molecules of the compound (M1) is 0.10 to 2.0. When the molar ratio [(α)/(β)] is 0.10 or more, a friction reduction effect tends to be enhanced. When the molar ratio [(α)/(β)] is 2.0 or less, a low-temperature storage stability tends to be attained.

From the viewpoint of reducing an effect on copper corrosion resistance, and from the viewpoint of facilitating an enhancement in a friction reduction effect, the molar ratio [(α)/(β)] is preferably 0.15 or more, and more preferably 0.20 or more.

From the viewpoint of more easily attaining low-temperature storage stability, the molar ratio [(α)/(β)] is preferably 1.2 or less, more preferably 1.0 or less, still more preferably 0.80 or less, and still more preferably 0.60 or less.

The upper limit values and the lower limit values in the numerical value ranges can be optionally combined. Specifically, the molar ratio is preferably 0.15 to 1.2, more preferably 0.20 to 1.0, still more preferably 0.20 to 0.80, and still more preferably 0.20 to 0.60.

Herein, the short-chain substituent group (α) and the long-chain substituent group (β) may or may not be in the same molecule. In other words, the average value of the molar ratio [(α)/(β)] of the short-chain substituent group (α) to the long-chain substituent group (β) in all the molecules of the compound (M1) represented by the general formula (m1) only needs to be in the range of 0.10 to 2.0.

Therefore, in the compound (M1), a molecule group (M1-1) in which all $R^1$, $R^2$, $R^3$, and $R^4$ in the general formula (m1) are the short-chain substituent group (α) may be present, a molecule group (M1-2) in which all $R^1$, $R^2$, $R^3$, and $R^4$ are the long-chain substituent group (β) may be present, or a molecule group (M1-3) in which a part of $R^1$, $R^2$, $R^3$, and $R^4$ is the short-chain substituent group (α) and the rest is the long-chain substituent group (β) may be present.

<Trinuclear Molybdenum Dithiocarbamate>

Examples of the trinuclear molybdenum dithiocarbamates include compounds represented by the following general formula (3).

$$Mo_3S_kE_mL_nA_pQ_z \quad (3)$$

In the general formula (3), k is an integer of 1 or more, m is an integer of 0 or more, and k+m is an integer of 4 to 10 and preferably an integer of 4 to 7. n is an integer of 1 to 4, p is an integer of 0 or more, and z is an integer of 0 to 5 and contains a non-stoichiometric value.

E's are each independently an oxygen atom or a selenium atom, and for example, can substitute sulfur in a core described below.

L's are each independently an anionic ligand having an organic group having a carbon atom. The total number of carbon atom in the organic group in the respective ligand is 14 or more, and the ligands may be the same or different.

A's are each independently an anion other than L's.

Q's are each independently a neutral compound that supplies an electron, and are present for filling a vacant coordination site on the trinuclear molybdenum compound.

The content of a molybdenum atom in the trinuclear molybdenum dithiocarbamates is preferably 2.0% by mass or more, more preferably 4.0% by mass or more, and still more preferably 5.0% by mass or more, relative to the whole amount of the trinuclear molybdenum dithiocarbamates. It is preferably 9.0% by mass or less, more preferably 7.0% by mass or less, and still more preferably 6.0% by mass or less.

The upper limit values and the lower limit values in the numerical value ranges can be optionally combined. Specifically, the molybdenum atom content is preferably 2.0% by mass to 9.0% by mass, more preferably 4.0% by mass to 7.0% by mass, and still more preferably 5.0% by mass to 6.0% by mass.

<Molybdenum Amine Complex>

Examples of the molybdenum amine complexes include molybdenum amine complexes obtained by a reaction between molybdenum trioxide and/or molybdic acid that are/is a hexavalent molybdenum compound, and an amine compound.

Preferable examples of the amine compound include alkylamines and dialkylamines.

Examples of the alkylamines and the dialkylamines that react with a hexavalent molybdenum compound include, but not particularly limited to, alkylamines and dialkylamines having alkyl groups having 1 to 30 carbon atoms.

The content of the molybdenum atom in the molybdenum amine complex is preferably 4.0% by mass or more, more preferably 6.0% by mass or more, and still more preferably 7.0% by mass or more, relative to the whole amount of the molybdenum amine complex. It is preferably 12.0% by mass or less, more preferably 10.0% by mass or less, and still more preferably 9.0% by mass or less.

The upper limit values and the lower limit values in the numerical value ranges can be optionally combined. Specifically, the molybdenum atom content is preferably 4.0% by mass to 12.0% by mass, more preferably 6.0% by mass to 10.0% by mass, and still more preferably 7.0% by mass to 9.0% by mass.

In the lubricating oil composition of the embodiment, the content of a molybdenum atom derived from the molybdenum-based friction modifier (B) (more specifically, the total content of MoDTC, MoDTP, and the molybdenum amine complex) is preferably 400 ppm by mass or more relative to the whole amount of the lubricating oil composition from the viewpoint of enhancing the friction reduction effect, and is preferably 800 ppm by mass or less relative to the whole amount of the lubricating oil composition from the viewpoint of reducing a sulfated ash content.

In the lubricating oil composition of the embodiment, the mass ratio (P/Mo) of the content of the phosphorus atom derived from the zinc dialkyldithiophosphate (A) to the content of the molybdenum atom derived from the molybdenum-based friction modifier (B) is required to be less than 2.0 from the viewpoint of fuel efficiency, and is preferably 0.5 to 1.9, more preferably 0.8 to 1.8, and still more preferably 1.0 to 1.7. When the P/Mo ratio is 2.0 or more, the lubricating oil composition has insufficient fuel efficiency.

In the lubricating oil composition of the embodiment, the mass ratio (S/Mo) of the content of the sulfur atom derived from the zinc dialkyldithiophosphate (A) to the content of the molybdenum atom derived from the molybdenum-based friction modifier (B) is preferably 1.5 to 6.0, more preferably 1.7 to 5.0, and still more preferably 2.2 to 4.0 from the viewpoint of reducing a friction coefficient due to appropriate coating formation, and contributing to fuel efficiency.

In the lubricating oil composition of the embodiment, the total content of the base oil, the zinc dialkyldithiophosphate (A), and the molybdenum-based friction modifier (B) is preferably 60.0% by mass or more, more preferably 70.0% by mass or more, still more preferably 80.0% by mass or more, and still more preferably 85.0% by mas or more, relative to the whole amount (100% by mass) of the lubricating oil composition.

In the lubricating oil composition of the embodiment, the upper limit value of the total content of the base oil, the zinc dialkyldithiophosphate (A), and the molybdenum-based friction modifier (B) may be 100% by mass, and if an additional additive for lubricating oil is contained, the upper limit value only needs to be controlled on the basis of a relationship with the additional additive for lubricating oil other than the zinc dialkyldithiophosphate (A) and the molybdenum-based friction modifier (B), and is preferably 99.5% by mass or less, more preferably 99.0% by mass or less, and still more preferably 98.0% by mass or less.

Additional Additive

The lubricating oil composition of the embodiment may contain an additive for lubricating oil except the aforementioned components.

Examples of the additive for lubricating oil include one or more selected from the group consisting of an antioxidant, a detergent-dispersant, an extreme-pressure agent, an oiliness agent, a pour point depressant, a viscosity index improver, a rust inhibitor, a copper deactivator, and an anti-foaming agent.

In consideration of handling ability and solubility in a lubricant base oil, additives such as a pour point depressant, a viscosity index improver, and an anti-foaming agent as used herein may be in a solution form in which the additives are diluted with and dissolved in a part of a dilution oil such as the lubricant base oil or another base oil. In this case, the following contents of the additives such as a pour point depressant, a viscosity index improver, and a anti-foaming agent as used herein mean the content in terms of active ingredient except the dilution oil (in terms of resin).

(Antioxidant)

As an antioxidant, a general compound to be blended as an antioxidant in the lubricating oil composition can be used without particular limitation.

Specific examples of the antioxidant include phenol-based antioxidants and amine-based antioxidants.

(Phenol-Based Antioxidant)

Examples of the phenol-based antioxidant include monophenol-based compounds such as 2,6-di-tert-butyl-p-cresol, 2,6-di-tert-butyl-4-ethylphenol, and octadecyl 3-(3,5-di-tert-butyl-4-hydroxyphenyl)propionate; and diphenol-based compounds such as 4,4'-methylenebis(2,6-di-tert-butylphenol) and 2,2'-methylenebis(4-ethyl-6-tert-butylphenol).

One kind of the compound may be used alone, or two or more kinds thereof may be used in combination.

(Amine-Based Antioxidant)

Examples of the amine-based antioxidant include monoalkyldiphenylamine-based compounds such as monooctyldiphenylamine and monononyldiphenylamine; dialkyldiphenylamine-based compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine, and monobutylphenylmonooctylphenylamine; polyalkyldiphenylamine-based compounds such as tetrabutyldiphenylamine, tetrahexyldiphenylamine, tetraoctyldiphenylamine, and tetranonyldiphenylamine; and naphthylamine-based compounds such as α-naphthylamine, phenyl-α-naphtylamine, butylphenyl-α-naphtylamine, pentylphenyl-α-naphtylamine, hexylphenyl-α-naphtylamine, heptylphenyl-α-naphtylamine, octylphenyl-α-naphtylamine, and nonylphenyl-α-naphthylamine.

One kind of the compound may be used alone, or two or more kinds thereof may be used in combination.

(Content of Antioxidant)

In the lubricating oil composition of the embodiment, the content of the antioxidant is preferably 0.01% by mass or more, more preferably 0.05% by mass or more, and still more preferably 0.10% by mass, relative to the whole amount of the lubricating oil composition. It is preferably 1.5% by mass or less, more preferably 1.2% by mass or less, and still more preferably 1.0% by mass or less.

The upper limit values and the lower limit values in the numerical value ranges can be optionally combined. Specifically, the content of the antioxidant is preferably 0.01% by mass to 1.5% by mass, more preferably 0.05% by mass to 1.2% by mass, and still more preferably 0.10% by mass to 1.0% by mass.

(Detergent-Dispersant)

Examples of the detergent-dispersant include metal sulfonates, metal salicylates, and metal phenates, and succinimide and boronated succinimide.

One kind of the detergent-dispersant may be used alone, or two or more kinds thereof may be used in combination.

When the lubricating oil composition of the embodiment contains the detergent-dispersant, the content of the detergent-dispersant is preferably 0.01% by mass to 10% by mass, and more preferably 0.1% by mass to 5% by mass, relative to the whole amount of the lubricating oil composition.

(Extreme-Pressure Agent)

As the extreme-pressure agent, an organometallic extreme-pressure agent, a sulfur-based extreme-pressure agent, a phosphorus-based extreme-pressure agent, and a sulfur-phosphorus-based extreme-pressure agent, which are used in a conventional lubricating oil composition, can be used.

One kind of the extreme-pressure agent may be used alone, or two or more kinds thereof may be used in combination.

The organometallic extreme-pressure agent only needs to be other than the zinc dialkyldithiophosphate (A) and the molybdenum-based friction modifier (B), and examples thereof include organic zinc compounds such as zinc dialkyldithiocarbamate (ZnDTC). One kind of the organometallic extreme-pressure agent may be used alone, or two or more kinds thereof may be used in combination.

Examples of the sulfur-based extreme-pressure agent include sulfurized oils and fats, sulfurized fatty acids, sulfurized esters, sulfurized olefins, monosulfides, polysulfides, dihydrocarbyl sulfides, thiadiazole compounds, alkylthiocarbamoyl compounds, thiocarbamate compounds, thioterpene compounds, and dialkylthiodipropionate compounds. One kind of the sulfur-based extreme-pressure agent may be used alone, or two or more kinds thereof may be used in combination.

Examples of the phosphorus-based extreme-pressure agent include phosphate esters such as an aryl phosphate, an alkyl phosphate, an alkenyl phosphate, and an alkylaryl phosphate; acidic phosphate esters such as a monoaryl acid phosphate, a diaryl acid phosphate, a monoalkyl acid phosphate, a dialkyl acid phosphate, a monoalkenyl acid phosphate, and a dialkenyl acid phosphate; phosphite esters such as an aryl hydrogen phosphite, an alkyl hydrogen phosphite, an aryl phosphite, an alkyl phosphite, an alkenyl phosphite, and an arylalkyl phosphite; acidic phosphite esters such as a monoalkyl acid phosphite, a dialkyl acid phosphite, a monoalkenyl acid phosphite, and a dialkenyl acid phosphite; and amine salts thereof. One kind of the phosphorus-based extreme-pressure agent may be used alone, or two or more kinds thereof may be used in combination.

Examples of the sulfur-phosphorus-based extreme-pressure agent include monoalkyl thiophosphates, dialkyl dithiophosphates, trialkyl trithiophosphates, and amine salts thereof, and zinc dialkyldithiophosphates (Zn-DTP). One kind of the sulfur-phosphorus-based extreme-pressure agent may be used alone, or two or more kinds thereof may be used in combination.

When the lubricating oil composition of the embodiment contains the extreme-pressure agent, the content of the extreme-pressure agent is preferably 0.1% by mass to 10% by mass, more preferably 0.5% by mass to 8.0% by mass, and still more preferably 0.8% by mass to 6.0% by mass, relative to the whole amount of the lubricating oil composition.

(Oiliness Agent)

Examples of the oiliness agent include aliphatic alcohols; fatty acid compounds such as a fatty acid and a fatty acid metal salt; ester compounds such as a polyol ester, a sorbitan ester, and a glyceride; and amine compounds such as an aliphatic amine.

One kind of the oiliness agent may be used alone, or two or more kinds thereof may be used in combination.

When the lubricating oil composition of the embodiment contains the oiliness agent, the content of the oiliness agent is preferably 0.1% by mass to 10% by mass, and more preferably 0.5% by mass to 5% by mass, relative to the whole amount of the lubricating oil composition.

(Pour Point Depressant)

Examples of the pour point depressant include polymethacrylates having a mass average molecular weight of about 50,000 to 150,000.

One kind of the pour point depressant may be used alone, or two or more kinds thereof may be used in combination.

When the lubricating oil composition of the embodiment contains the pour point depressant, the content of the pour point depressant is preferably 0.01% by mass to 5% by mass, and more preferably 0.02% by mass to 2% by mass, relative to the whole amount of the lubricating oil composition.

(Viscosity Index Improver)

Examples of the viscosity index improver include polymers such as a non-dispersant-type polymethacrylate, a dispersant-type polymethacrylate, an olefinic copolymer (e.g., an ethylene-propylene copolymer), a dispersant-type olefinic copolymer, and a styrene-based copolymer (e.g., a styrene-diene copolymer, and a styrene-isoprene copolymer).

One kind of the viscosity index improver may be used alone, or two or more kinds thereof may be used in combination.

When the lubricating oil composition of the embodiment contains the viscosity index improver, the content of the viscosity index improver in terms of resin is preferably 0.01% by mass to 10% by mass, more preferably 0.02% by mass to 7% by mass, and still more preferably 0.03% by mass to 5% by mass, relative to the whole amount of the lubricating oil composition.

(Rust Inhibitor)

Examples of the rust inhibitor include alkylbenzenesulfonates, dinonylnaphthalenesulfonates, organic phosphite esters, organic phosphate esters, alkenylsuccinate esters, and polyhydric alcohol esters of alkenylsuccinic acid.

One kind of the rust inhibitor may be used alone, or two or more kinds thereof may be used in combination.

When the lubricating oil composition of the embodiment contains the rust inhibitor, the content of the rust inhibitor is preferably 0.01% by mass to 10.0% by mass, and more preferably 0.03% by mass to 5.0% by mass, relative to the whole amount of the lubricating oil composition.

(Copper Deactivator)

Examples of the copper deactivator include benzotriazole-based compounds, tolyltriazole-based compounds, thiadiazole-based compounds, imidazole-based compounds, and pyrimidine-based compounds.

One kind of the copper deactivator may be used alone, or two or more kinds thereof may be used in combination.

When the lubricating oil composition of the embodiment contains the copper deactivator, the content of the copper deactivator is preferably 0.01% by mass to 5.0% by mass, and more preferably 0.03% by mass to 3.0% by mass, relative to the whole amount of the lubricating oil composition.

(Anti-Foaming Agent)

Examples of the anti-foaming agent include silicone-based anti-foaming agents, fluorine-based anti-foaming agents such as a fluorosilicone oil and a fluoroalkyl ether, and polyacrylate-based anti-foaming agents.

One kind of the anti-foaming agent may be used alone, or two or more kinds thereof may be used in combination.

When the lubricating oil composition of the embodiment contains the anti-foaming agent, the content of the anti-foaming agent in terms of resin is preferably 0.0001% by mass to 0.20% by mass, and more preferably 0.0005% by mass to 0.10% by mass, relative to the whole amount of the lubricating oil composition.

Physical Values of Lubricating Oil Composition

The kinematic viscosity at 100° C. of the lubricating oil composition of the embodiment needs to be 5.0 to 7.1 $mm^2/s$. When the kinematic viscosity at 100° C. of the lubricating oil composition is less than 5.0 $mm^2/s$, wear resistance is insufficient. When it is more than 7.1 $mm^2/s$, fuel efficiency is insufficient.

From the viewpoint described above, the kinematic viscosity at 100° C. of the lubricating oil composition is preferably 5.2 $mm^2/s$ or more, and more preferably 5.4 $mm^2/s$ or more, and preferably 6.6 $mm^2/s$ or less, and more preferably 6.2 $mm^2/s$ or less. The upper limit values and the lower limit values can be optionally combined. Specifically, the kinematic viscosity at 100° C. is preferably 5.2 to 6.6 $mm^2/s$, and more preferably 5.4 to 6.2 $mm^2/s$.

The viscosity index of the lubricating oil composition of the embodiment is preferably 90 or more, more preferably 110 or more, still more preferably 120 or more, and still more preferably 130 or more. When the viscosity index is 90 or more, a viscosity change with temperature is small.

A friction coefficient measured by performing a friction test after the lubricating oil composition of the embodiment is rubbed using a mini traction machine (MTM) tester under the following condition is preferably 0.020 to 0.070, preferably 0.030 to 0.065, and further preferably 0.035 to 0.060.

Test piece: a disk of a standard test piece (AISI 52100) and a ball (¾ inches) of the same material <Rubbing Condition>

Rolling speed: 100 mm/s
Slipping speed: 50 mm/s
Slip-to-roll ratio: 50%
Rubbing time: 60 minutes
Load: 10 N
Oil temperature: 100° C.

<Friction Test Condition>

Rolling speed: 9 mm/s
Slipping speed: 4.5 mm/s
Slip-to-roll ratio: 50%
Load: 10 N
Oil temperature: 100° C.

Lubricating Method

A lubricating method of the embodiment is a method using the lubricating oil composition, more specifically a method in which metal members are lubricated with the lubricating oil composition interposed therebetween.

Method for Producing Lubricating Oil Composition

A method for producing a lubricating oil composition of the embodiment includes a step of mixing at least the zinc dialkyldithiophosphate (A) and the molybdenum-based friction modifier (B) with the base oil.

Details of the lubricating oil composition are the same as described above.

Application of Lubricating Oil Composition

The lubricating oil composition of the embodiment is used for an internal-combustion engine for a motorcycle and the like, and is suitably used for a two-wheeled vehicle having an engine with a roller bearing.

In an internal-combustion engine for a motorcycle, many rotary shafts and many bearings supporting the shafts are used.

For the kinds of the bearings, a sliding bearing in which friction is reduced by an oil film of a lubricant present between a shaft and the bearing, a roller bearing in which friction is reduced by using an oil film to support a rotator, such as a ball or a roller, provided in the bearing, and the like are known. As the roller bearing, a ball bearing, a roller bearing, a needle bearing, or the like is widely used depending on the shape of the rotator.

The ball bearing and the roller bearing generally have an outer ring, an inner ring, a rotator, and a holder that holds the position of the rotator. The needle bearing may include only a rotator and a holder depending on the shape of the holder. Therefore, the needle bearing can be made more compact and lighter than the ball bearing and the roller bearing by the size and weight of the outer ring and the inner ring.

From the viewpoint of a simple structure and miniaturization of an engine, as a bearing in an internal-combustion engine of a motorcycle, the roller bearing, especially the needle bearing is often used. In a roller-type valve mechanism of a four-wheeled vehicle, the needle bearing may also be used.

However, the roller bearing has a smaller contact area with the shaft than the sliding bearing, and therefore the oil film retention for retaining a lubricating oil composition is insufficient. Thus, an appropriate oil film is not retained at a sleeve portion inside an engine, friction is increased, and engine parts may be damaged by fatigue and wear.

The lubricating oil composition according to the embodiment is excellent in low friction at a mixed lubrication area that is generated in such a roller bearing, and therefore the lubricating oil composition is suitably used for the roller bearing and the like.

EXAMPLES

Next, the present invention will be described in more detail by Examples, but the present invention is not limited to the examples. Various properties of components and obtained lubricant base oils used in Examples and Comparative Examples were measured by the following methods.

<Kinematic Viscosity and Viscosity Index>

The kinematic viscosity and the viscosity index were measured or calculated in accordance with JIS K 2283:2000.

Examples 1 to 3 and Comparative Examples 1 to 4

A base oil and various additives shown below were added in blending amounts shown in Table 1, and sufficiently mixed to prepare each lubricating oil composition.

Details of base oils and various additives used in Examples and Comparative Examples are as follows.

(Base Oil)

Base oil 1: mineral oil that is classified into Group III in API base oil category and was subjected to hydrogenation refining (kinematic viscosity at 40° C.=19.7 $mm^2/s$, kinematic viscosity at 100° C.=4.3 $mm^2/s$, viscosity index=135)

Base oil 2: mineral oil that is classified into Group III in API base oil category and was subjected to hydrogenation refining (kinematic viscosity at 40° C.=32.7 $mm^2/s$, kinematic viscosity at 100° C.=6.0 $mm^2/s$, viscosity index=132)

(Component (A))

ZnDTP-1: secondary zinc dialkyldithiophosphate, "OLOA5283" available from Chevron Oronite Co. LLC, phosphorus atom content: 7.2% by mass, sulfur atom content: 15.0% by mass ZnDTP-2: primary zinc dialkyldithiophosphate, "OLOA262" available from Chevron Oronite Co. LLC, phosphorus atom content: 7.5% by mass, sulfur atom content: 15.0% by mass (Component (B))

MoDTC: binuclear molybdenum dithiocarbamate, "SAKURA-LUBE 515" available from ADEKA Corporation, molybdenum atom content: 10.0% by mass, sulfur atom content: 10.9% by mass (a binuclear molybdenum dithiocarbamate in which in the general formula (m1), the number of carbon atoms in an aliphatic hydrocarbon group in a short-chain substituent group (α) is 8 and the number of carbon atoms in an aliphatic hydrocarbon group in a long-chain substituent group (β) is 13. In the general formula (m1), $X^1$, $X^2$, $X^3$, and $X^4$ are a sulfur atom. The molar ratio [(α)/(β)] of the short-chain substituent group (α) to the long-chain substituent group (β) in all the molecules of MoDTC-1 is 1.0.)

(Additional Additives)

Additive package containing a calcium-based detergent, a pour point depressant, and the like.

The prepared lubricating oil compositions were subjected to the following tests. The results are shown in Table 1.

Contents of Phosphorus Atom, Molybdenum Atom, and Sulfur Atom

The content of each atom was calculated from the amount of each additive blended and the content of each atom contained in each additive.

MTM Friction Test

After rubbing was performed using a mini traction machine (MTM) tester under the following rubbing condition, a friction test was performed under the following friction test condition, and a friction coefficient was determined.

Test piece: a disk of a standard test piece (AISI 52100) and a ball (¾ inches) of the same material <Rubbing Condition>

Rolling speed: 100 mm/s
Slipping speed: 50 mm/s
Slip-to-roll ratio (SRR): 50%
Rubbing time: 60 minutes
Load: 10 N
Oil temperature: 100° C.

<Friction Test Condition>

Rolling speed: 9 mm/s
Slipping speed: 4.5 mm/s
Slip-to-roll ratio (SRR): 50%
Load: 10 N
Oil temperature: 100° C.

TABLE 1

| | | | | Example 1 | Example 2 | Example 3 | Comparative Example 1 | Comparative Example 2 | Comparative Example 3 | Comparative Example 4 |
|---|---|---|---|---|---|---|---|---|---|---|
| composition | Base oil | Base oil 1 | % by mass | 69.08 | 68.88 | 69.13 | 70.20 | 67.98 | 69.38 | 69.58 |
| | | Base oil 2 | % by mass | 20.00 | 20.00 | 20.00 | 20.00 | 20.00 | 20.00 | 20.00 |
| | Component (A) | ZnDTP-1 | % by mass | 1.12 | 1.12 | — | — | 1.12 | 1.12 | 1.12 |

TABLE 1-continued

| | | | Example 1 | Example 2 | Example 3 | Comparative Example 1 | Comparative Example 2 | Comparative Example 3 | Comparative Example 4 |
|---|---|---|---|---|---|---|---|---|---|
| | ZnDTP-2 | % by mass | — | — | 1.07 | — | — | — | — |
| Component (B) | MoDTC | % by mass | 0.50 | 0.70 | 0.50 | 0.50 | 1.60 | 0.20 | — |
| Additional additives | | % by mass | 9.30 | 9.30 | 9.30 | 9.30 | 9.30 | 9.30 | 9.30 |
| Total | | % by mass | 100.00 | 100.00 | 100.00 | 100.00 | 100.00 | 100.00 | 100.00 |
| Properties of base oil | Kinematic viscosity (40° C.) | $mm^2/s$ | 21.64 | 21.64 | 21.64 | 21.61 | 21.67 | 21.63 | 21.63 |
| Various properties of lubricating oil composition | Kinematic viscosity (40° C.) | $mm^2/s$ | 28.87 | 29.09 | 29.07 | 28.57 | 29.4 | 28.87 | 28.76 |
| | Kinematic viscosity (100° C.) | $mm^2/s$ | 5.693 | 5.703 | 5.712 | 5.653 | 5.74 | 5.682 | 5.671 |
| | Viscosity index | | 142 | 141 | 142 | 142 | 141 | 141 | 142 |
| Content of P atom derived from ZnDTP | | ppm by mass | 806 | 806 | 803 | 0 | 806 | 806 | 806 |
| Content of Mo atom derived from MoDTC | | ppm by mass | 500 | 700 | 500 | 500 | 1600 | 200 | 0 |
| Content of S atom derived from ZnDTP | | % by mass | 0.17 | 0.17 | 0.16 | — | 0.17 | 0.17 | 0.17 |
| Content of S atom derived from MoDTC | | % by mass | 0.05 | 0.07 | 0.05 | 0.05 | 0.16 | 0.02 | — |
| Content of P atom derived from ZnDTP/ Content of Mo atom derived from MoDTC | | | 1.61 | 1.15 | 1.61 | — | 0.50 | 4.03 | — |
| Content of S atom derived from ZnDTP/ Content of Mo atom derived from MoDTC | | | 3.40 | 2.43 | 3.20 | — | 1.06 | 8.50 | — |
| MTM friction test | | | 0.046 | 0.046 | 0.0541 | 0.1086 | 0.0783 | 0.0743 | 0.1464 |

The lubricating oil compositions prepared in Examples 1 to 3 had a mass ratio (P/Mo) of the content of a phosphorus atom derived from the zinc dialkyldithiophosphate (A) to the content of a molybdenum atom derived from the molybdenum-based friction modifier (B) of 0.8 or more and less than 2.0, and a friction coefficient in the MTM friction test of 0.055 or less, and therefore, the lubricating oil compositions were confirmed to have a favorable fuel efficiency performance.

In contrast, the lubricating oil compositions prepared in Comparative Examples 1 to 4 did not contain the zinc dialkyldithiophosphate (A) or the molybdenum-based friction modifier (B), and had a P/Mo ratio of less than 0.8 or 2.0 or more, a high intermetallic friction coefficient measured using the MTM tester, and lower fuel efficiency.

The invention claimed is:

1. A lubricating oil composition for a two-wheeled vehicle, comprising:

a base oil;

a zinc dialkyldithiophosphate; and a molybdenum-based friction modifier, wherein a mass ratio of a content of a phosphorus atom derived from the zinc dialkyldithiophosphate to a content of a molybdenum atom derived from the molybdenum-based friction modifier is 0.8 or more and less than 2.0, and a kinematic viscosity of the lubricating oil composition at 100° C. is in a range of 5.0 to 7.1 $mm^2/s$.

2. The lubricating oil composition for a two-wheeled vehicle according to claim 1, wherein the zinc dialkyldithiophosphate has a secondary alkyl group.

3. The lubricating oil composition for a two-wheeled vehicle according to claim 1, wherein the content of a phosphorus atom derived from the zinc dialkyldithiophosphate is in a range of 600 to 900 ppm by mass.

4. The lubricating oil composition for a two-wheeled vehicle according to claim 1, wherein the content of a molybdenum atom derived from the molybdenum-based friction modifier is in a range of 400 to 800 ppm by mass.

5. The lubricating oil composition for a two-wheeled vehicle according to claim 1, wherein a content of a sulfur atom derived from the zinc dialkyldithiophosphate is in a range of 0.12 to 0.22% by mass.

6. The lubricating oil composition for a two-wheeled vehicle according to claim 1, wherein a kinematic viscosity of the base oil at 40° C. is in a range of 18.0 to 24.0 $mm^2/s$.

7. A method of lubricating a two-wheeled vehicle, comprising:

applying the lubricating oil composition of claim 1 to a roller bearing of an engine in a two-wheeled vehicle.

8. The lubricating oil composition for a two-wheeled vehicle according to claim 2, wherein the content of a phosphorus atom derived from the zinc dialkyldithiophosphate is in a range of 600 to 900 ppm by mass.

9. The lubricating oil composition for a two-wheeled vehicle according to claim 2, wherein the content of a molybdenum atom derived from the molybdenum-based friction modifier is in a range of 400 to 800 ppm by mass.

10. The lubricating oil composition for a two-wheeled vehicle according to claim 2, wherein a content of a sulfur atom derived from the zinc dialkyldithiophosphate is in a range of 0.12 to 0.22% by mass.

11. The lubricating oil composition for a two-wheeled vehicle according to claim 2, wherein a kinematic viscosity of the base oil at 40° C. is in a range of 18.0 to 24.0 $mm^2/s$.

12. The lubricating oil composition for a two-wheeled vehicle according to claim 3, wherein the content of a molybdenum atom derived from the molybdenum-based friction modifier is in a range of 400 to 800 ppm by mass.

13. The lubricating oil composition for a two-wheeled vehicle according to claim 3, wherein a content of a sulfur atom derived from the zinc dialkyldithiophosphate is in a range of 0.12 to 0.22% by mass.

14. The lubricating oil composition for a two-wheeled vehicle according to claim 3, wherein a kinematic viscosity of the base oil at 40° C. is in a range of 18.0 to 24.0 $mm^2/s$.

15. The lubricating oil composition for a two-wheeled vehicle according to claim 4, wherein a content of a sulfur atom derived from the zinc dialkyldithiophosphate is in a range of 0.12 to 0.22% by mass.

16. The lubricating oil composition for a two-wheeled vehicle according to claim 4, wherein a kinematic viscosity of the base oil at 40° C. is in a range of 18.0 to 24.0 $mm^2/s$.

17. The lubricating oil composition for a two-wheeled vehicle according to claim 5, wherein a kinematic viscosity of the base oil at 40° C. is in a range of 18.0 to 24.0 $mm^2/s$.

18. The lubricating oil composition for a two-wheeled vehicle according to claim 8, wherein a content of a sulfur atom derived from the zinc dialkyldithiophosphate is in a range of 0.12 to 0.22% by mass.

19. The lubricating oil composition for a two-wheeled vehicle according to claim 8, wherein a kinematic viscosity of the base oil at 40° C. is in a range of 18.0 to 24.0 $mm^2/s$.

20. The lubricating oil composition for a two-wheeled vehicle according to claim 18, wherein a kinematic viscosity of the base oil at 40° C. is in a range of 18.0 to 24.0 $mm^2/s$.

* * * * *